US005345970A

United States Patent [19]

Leyderman et al.

[11] Patent Number: 5,345,970

[45] Date of Patent: Sep. 13, 1994

[54] VIRTUAL VALVE STOP

[75] Inventors: Alexander D. Leyderman, Manlius; Jiawei Lu, North Syracuse, both of N.Y.

[73] Assignee: Carrier Corporation, Syracuse, N.Y.

[21] Appl. No.: 115,077

[22] Filed: Sep. 2, 1993

[51] Int. Cl.[5] ..... F16K 15/16

[52] U.S. Cl. ..... 137/856

[58] Field of Search ..... 137/856

[56] References Cited

U.S. PATENT DOCUMENTS

| | | | |
|---|---|---|---|
| 1,029,726 | 6/1912 | Sprado . | |
| 1,480,608 | 1/1924 | Gardner . | |
| 3,200,838 | 8/1965 | Sheaffer | 137/512.15 |
| 4,082,295 | 4/1978 | Bainard | 137/856 X |
| 4,083,184 | 4/1978 | Ushijima | 137/856 X |
| 4,778,360 | 10/1988 | Ikeda | 137/856 X |
| 4,901,760 | 2/1990 | Nagashima | 137/514 |
| 5,016,669 | 5/1991 | Jamieson | 137/512 |

*Primary Examiner*—Robert G. Nilson

[57] ABSTRACT

The profile of the valve stop of a discharge valve conforms to the maximum bending stress or the maximum allowable fatigue stress whereby impact of the valve element with the valve stop occurs when the valve element has the least kinetic energy and highest potential energy such that the least possible kinetic energy is transferred to the valve stop.

3 Claims, 5 Drawing Sheets

VIRTUAL VALVE STOP

BACKGROUND OF THE INVENTION

In positive displacement compressors employing valves, the valve members may cycle hundreds of times per minute. Valve stops are commonly employed to protect the valve member from being overstressed by limiting movement of the valve member. For example, under liquid slugging conditions, the mass flow during a cycle is such that the valve member would be excessively displaced if a valve stop was not present. Engagement of the valve stop by the valve member can be a significant source of noise. Specifically, a discharge valve stop in a rolling piston rotary compressor has been identified as one of the major noise sources through the impact kinetic energy transmission of a discharge valve member. The impact between the valve and valve stop generates significant noise radiation at the natural frequency of the valve stop due to transmission of valve kinetic energy to the valve stop and the compressor shell.

SUMMARY OF THE INVENTION

A discharge valve stop in a rotary compressor has been identified as a major noise source through the impact kinetic energy transmission of a discharge valve. To reduce impact between the valve member and the valve stop, two approaches can be applied. One approach is to design a low attitude profile so that the impact occurs at the moment when only a small amount of kinetic energy has been developed in the valve member. Another approach is to design a high attitude profile so that the impact occurs at the moment when most of the kinetic energy in the valve member has been converted into strain energy.

The first approach is limited by the fact that the valve stop cannot be designed too low so that the efficiency is affected. The second approach is limited by the fact that the valve stop cannot be designed too high so that the valve member stress exceeds its allowable fatigue stress. One big advantage which the second approach has with current material strength of the valve member is that, under normal operating conditions, the valve member contacts the valve stop only within a very small root region. This reduces impact significantly. More fully, impact only occurs under abnormal severe condition, such as liquid slugging conditions. To exploit fully the highest attitude profile of the stop under the allowable stress limitation, the stop is designed in such a way, that at each contact point of the profile the valve member reaches its maximum allowable normal stress.

It is also well understood that besides the attitude of a stop, the profile of a stop is also an important factor for sound. A smooth and gradual contact with a longer time interval transmits less spectrum rich energy and smaller deflection than a short time high velocity impact. Since under normal operating conditions, there is only a very small contact region, a virtual valve stop for an allowable stress is the best choice since the choice of a profile for smooth and gradual contacting is no longer critically important.

It is realized that for a small deflection assumption, the stress in a valve member is proportional to its curvature. However, the following given formulation is more general. It is suitable for large deflections and also gives the contact region between a valve member and a stop and valve member tip deflection as a function of a static force. This force may be used as an estimation to determine the order of magnitude of dynamic impact between a valve member and a stop for different operating conditions. Since the stop is designed using quasi-static approach, the dynamic deflection of a valve may not exactly follow the stop profile. However, it can be well assumed that the deflection before contacting is very close to the stop profile because the deflection is contributed mainly by its first mode if the valve is relatively stiff enough and high modes will contribute to the later deflection after contacting. The experimental results of strain variation on the valve show that the valve strain, $\sigma$, descends monotonically after contacting. This evidence shows that the higher stress than $\sigma_{max}$ due to high modes after contacting does not exist. Hence, the predicted static $\sigma_{max}$ can be safely used as a ceiling over the real maximum dynamic stress.

It is an object of this invention to reduce sound radiation in a positive displacement compressor.

It is another object of this invention to have valve impact with the valve stop occur at the moment when the valve has the least kinetic and highest potential energy.

It is a further object of this invention to minimize the kinetic energy transferred to the valve stop by the valve member. These objects, and others as will become apparent hereinafter, are accomplished by the present invention.

Basically, the valve stop is designed in such a way that, at each potential contact point of the profile, the valve reaches maximum allowable stress such that the valve stop attitude will be at the highest possible position, and the least possible kinetic energy will be transferred to the valve stop.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
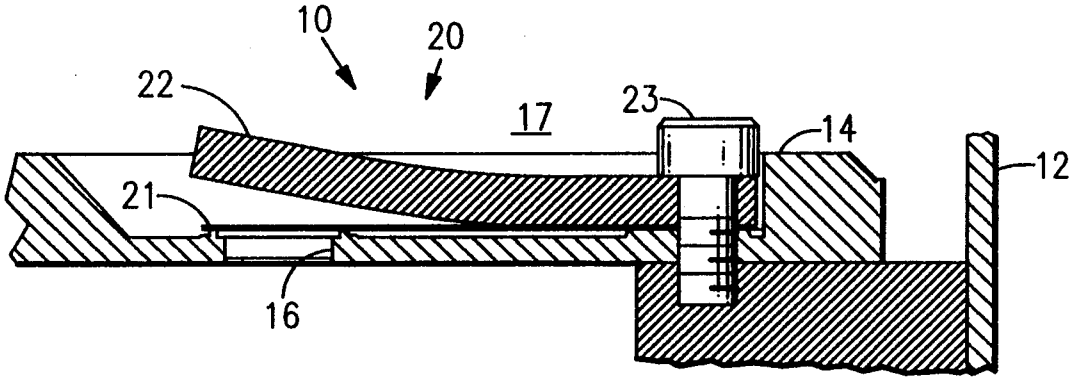
FIG. 1 is a sectional view of a discharge valve incorporating the present invention.

In FIG. 1, the numeral 10 generally designates a high side, positive displacement, hermetic compressor having a shell 12. Discharge port 16 is formed in member 14 which would be the motor side bearing end cap in the case of a fixed vane or rolling piston compressor. Discharge port 16 is controlled by valve assembly 20 which includes valve member 21, valve stop 22 and bolt or other fastening member 23 for securing valve member 21 and valve stop 22 to member 14.

In operation, when the pressure at discharge port 16 exceeds the pressure in chamber 17 defined by the shell 12 of compressor 10, valve member 21 opens, by deforming or flexing, to permit flow through discharge port 16 into chamber 17. In the absence of valve stop 22, the valve member 21 would flex to a curved configuration during the discharge stroke and seat on discharge port 16 during the suction stroke. The valve stop 22 is only present to prevent excessive flexure of valve member 21, such as would happen during liquid slugging conditions, which would permanently deform the valve member 21. Accordingly, current designs have the valve member 21 impacting the valve stop 22 during normal operation with resultant noise. The present invention configures the valve stop 22 to the shape of valve member 21 at the maximum allowable stress such that any impact occurs at the moment when valve member 21 has the least kinetic and greatest potential energy and thereby the least kinetic energy to transfer to valve stop 22. The maximum allowable stress would differ from the maximum stress of the valve member 21 by whatever design safety factor is desired and will result in an actual touching of the valve stop 22 by valve member 21 rather than a nominal touching.

Valve member 21 is very thin in its bending direction so the shear stress contribution to the resultant maximum principal stress can be neglected. It is assumed that the stop 22 is very thick as compared with the thickness of the valve member 21 so that the valve member 21 can be considered to be clamped at the root of the stop similar to a cantilever beam. It is also assumed that the force applied on the valve head is taken as applied at the tip of a cantilever beam which corresponds to the head center of the valve member 21. The accuracy of this approximation depends on the accuracy requirement of the problem. It will normally predict a good order of stress level in the valve member 21. Thus, a cantilever beam will be used to represent the valve member 21 in the following discussion.

In the design logic, the superposition of force, displacement and stress has been used for all the calculation steps. This is valid for quasi-static deflection of the beam. To avoid confusion in the following derivation, we assign the subscript i to be the calculation step with $i=0$ denoting no test force applied and the subscript j to be the location index for $x_j$ with $x_0$ the beam origin.

Figure 2:
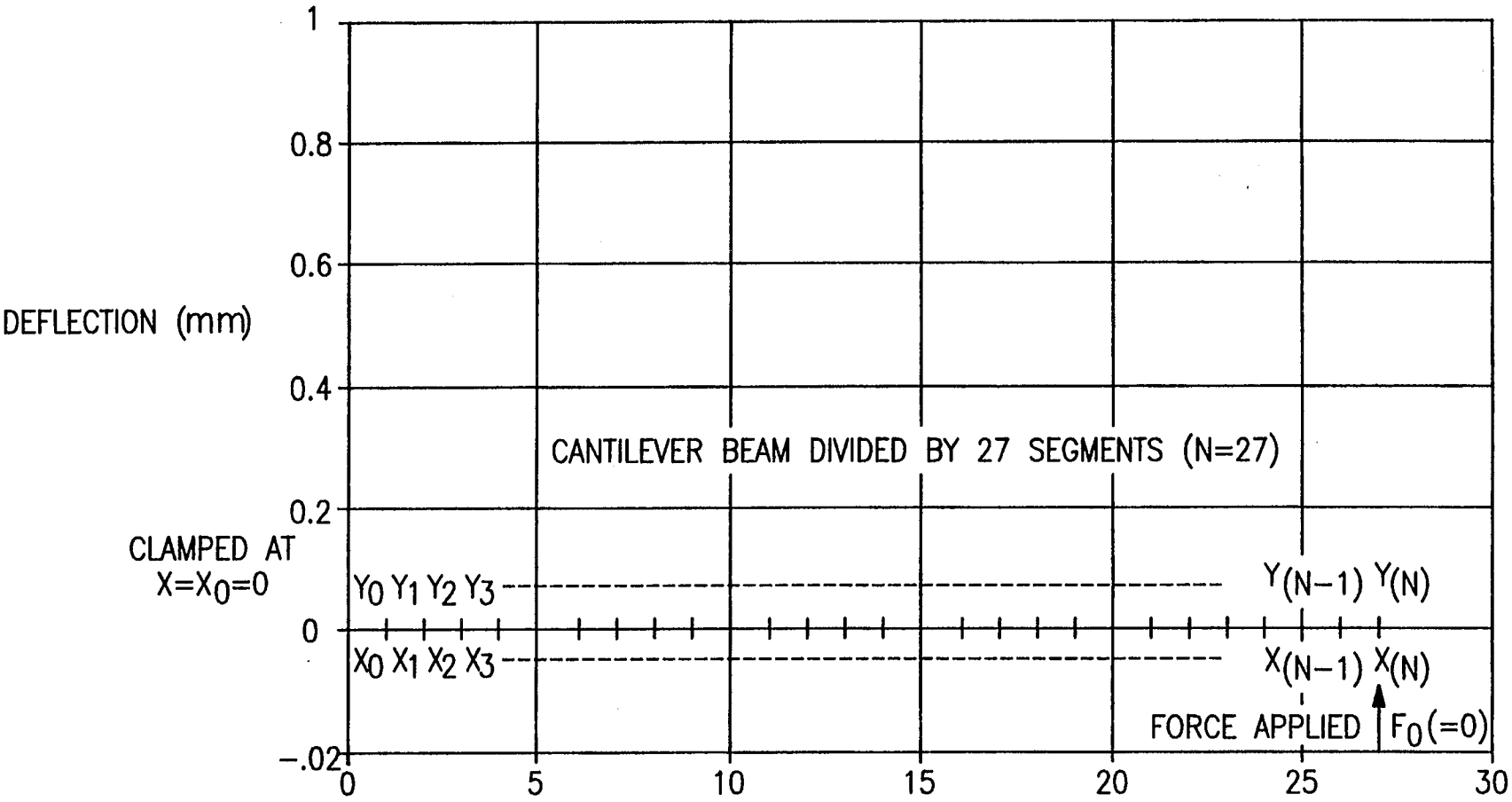
FIG. 2 is a graph of the beam deflection at $i=0$ with no force applied.
Figure 3:
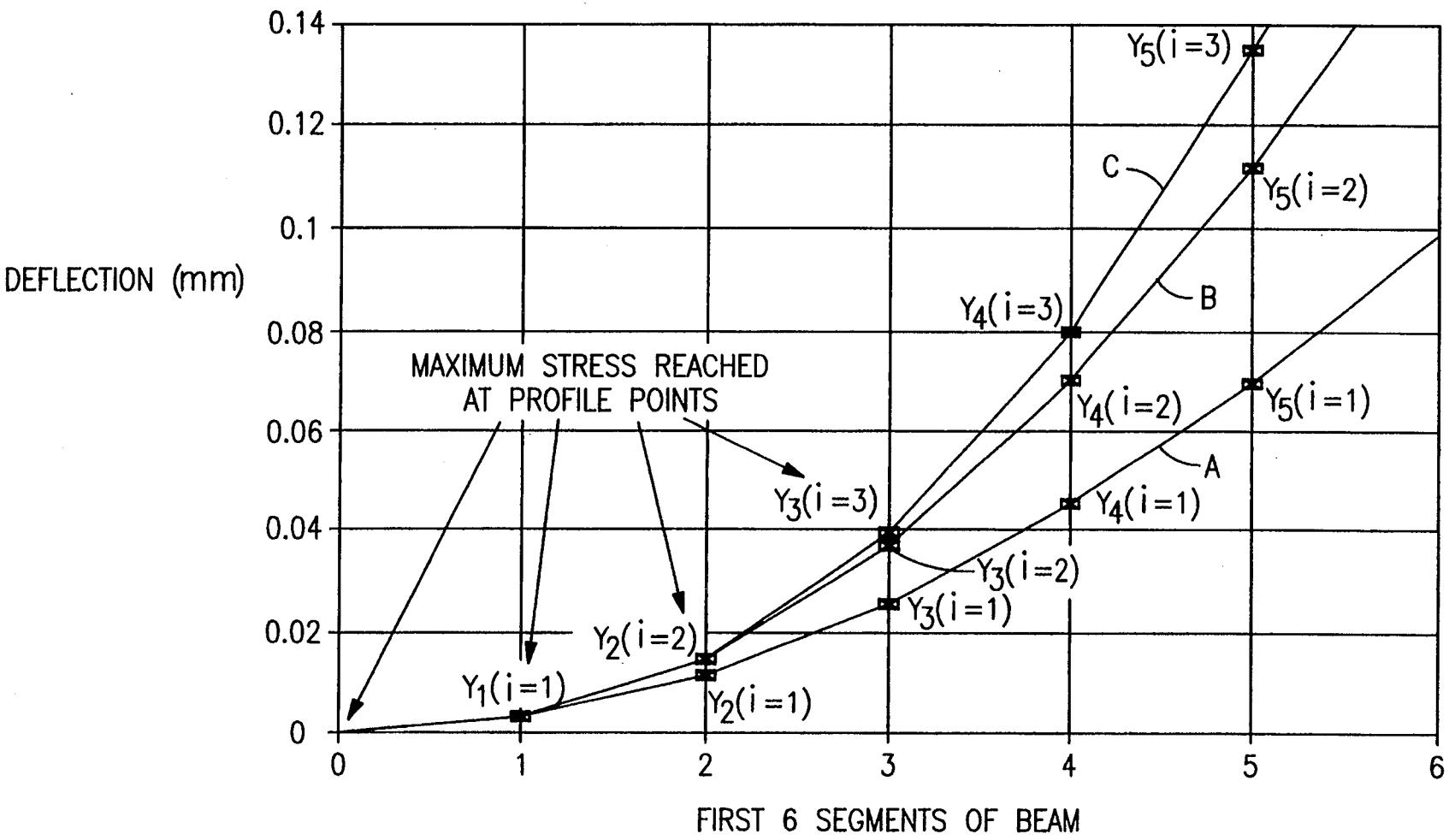
FIG. 3 is a graph of beam deflection at $i=1,2,3$ with forces $F_1$, $F_2$, $F_3$, applied at the tip.

As shown in FIG. 2, the cantilever beam with a length L is clamped at $x=x_0=0$ and is divided into n segments of $\Delta x$ ($=x_j-x_{j-1}$, where $j=1,2,\ldots,n$). FIG. 3 shows that the beam is deflected, as shown in curve A, under the tip force $F_1$ for $i=1$ so that the stress at $x=0$ reaches to $\sigma_{max}$ where $\sigma_{max}$ is the maximum bending stress, or the maximum allowable fatigue stress if it is so designed. When the stress at $x=0$ is $\sigma_{max}$, we put a stop point on the beam at $x=x_1$ to prevent the beam from being overstressed at $x=0$ if the beam is going to deflect more due to an additional force added later. Thus, the stop point is the first point (except for $x=0$) of the stop profile. The beam stress at $x=x_1$ is $\sigma_1$ and the deflection at $x=x_1$ is $y_1$ now. FIG. 3 also shows the beam deflection at $i=2$, curve B, when a larger force $F_2$ ($=F_1+\sigma F_1$) is applied. The magnitude of $\sigma F_1$ is chosen so that the beam stress at $x=x_1$ reaches to $\sigma_{max}$. Then, another stop point is put on the beam $Y_2$ at $x=x_2$. The deflection for $i=3$ under force $F_3$, curve C, determines the profile point $y_3$ at $x=x_3$. In this way all the coordinates of the stop profile with n points can be determined.

Design equations are given as follows. The required force $\Delta F_i$ to produce the stress $\Delta\sigma_i$ is given by:

$$\Delta F_i = \frac{I\Delta\sigma_i}{L_{i-1}\delta}, \quad i = 1, 2, \ldots, n, \tag{1}$$

where I is the moment of inertia of the beam cross section area and $\delta$ is the half thickness of the beam in the bending direction. Note that the stress or its increment is calculated only at the stop point when $i=j$. The stress increment $\Delta\sigma_i$ is given by:

$$\Delta\sigma_i=\sigma_{max}-\sigma_i,\ i=1,2,\ldots,n, \tag{2}$$

and the length $L_i$ is called the free beam length and defined by:

$$L_i=L_0-i\,\Delta x,\ i=1,2,\ldots,n-1, \tag{3}$$

where $L_o$ is the length of the beam. The beam stress $\sigma_i$ for each calculation step at the location $x_j$ can be simply written by the relationship:

$$\sigma_i = \frac{L_{i-1}-\Delta x}{L_{i-1}}\sigma_{max}, \quad i = 1, 2, \ldots, n. \tag{4}$$

Denote the beam deflection by $y_{i,j}$ ($i=1,2,\ldots,n$, $j=1,2,\ldots n$). The coordinates of the stop profile are ($x_j$, $y_{i,j}\delta_{i,j}$) where the Dirac delta function is given by:

$$\delta_{i,j} = 1 \text{ if } i=j, \quad = 0 \text{ if } i\neq j. \tag{5}$$

The y coordinate of the profile is the superposition of the beam deflection under each test force and can be calculated using the recursive relationship:

$$y_{i,j}=y_{i-1,j}+\Delta y_{i-1,j}\ j\geqq i, \tag{6}$$

with $y_{0,j}=0$ and $\Delta y_{0,j}=y_{1,j}$ for $j=1,2,\ldots,n$. The deflection variation Ay can be obtained by:

$$\Delta y_{i-1,j} = \frac{x_j^2(3L_{i-1}-x_j)}{6EI}\Delta F_i, \quad j\geqq i, \quad j = 1, 2, \ldots, n, \tag{7}$$

where E is the modulus of elasticity of the beam. The total static force applied at each step can be calculated using:

$$F_i = \sum_{k=0}^{i-1}\Delta 1F_k, \quad i = 1, 2, \ldots, n, \tag{8}$$

by assuming $\Delta F_0=F_1$.

Figure 4:
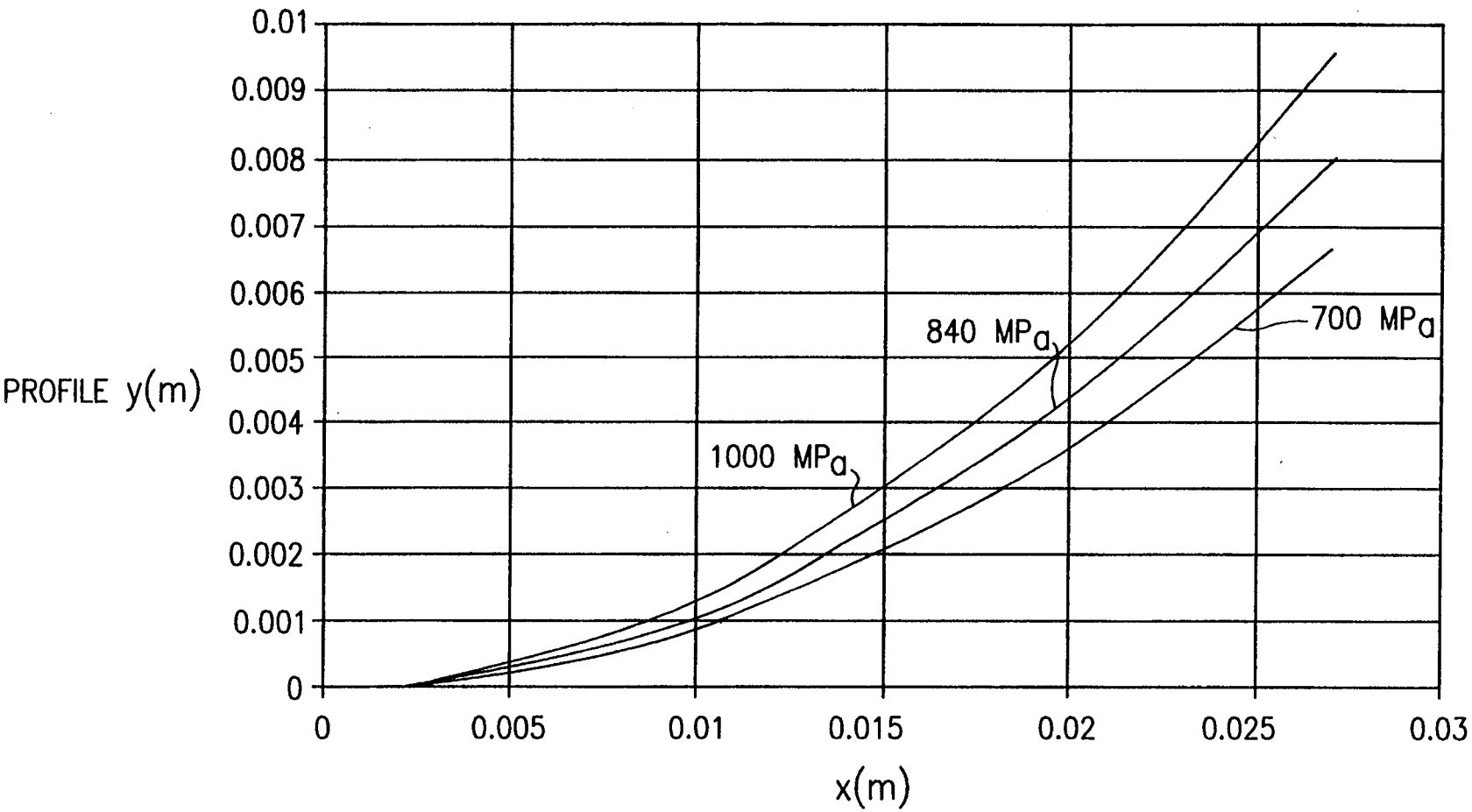
FIG. 4 is a graph of virtual valve stop profiles for maximum normal stresses at 700, 840 and 1000 MPa.
Figure 5:
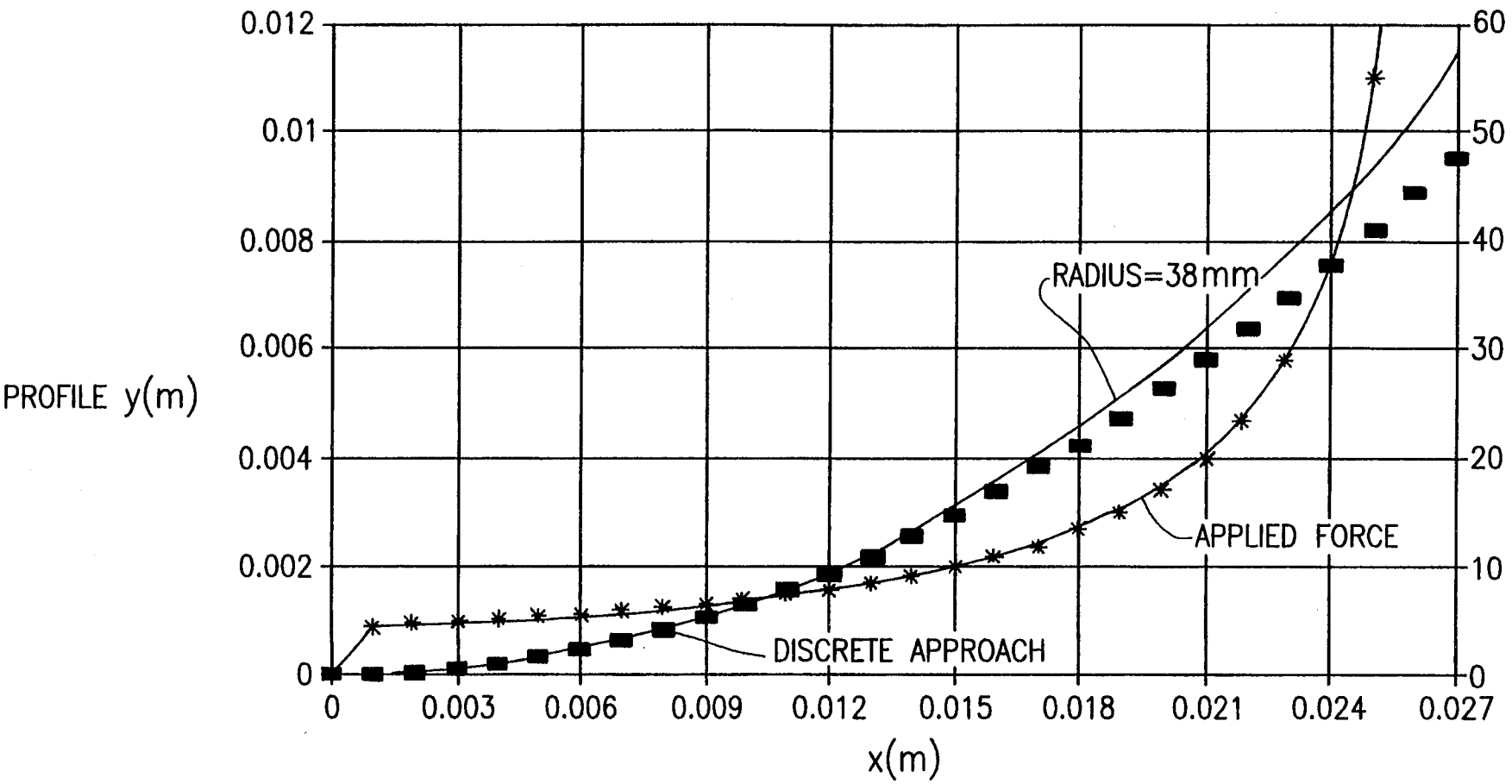
FIG. 5 is a comparison of the profiles obtained by the discrete approach of the present invention, an equal curvature approach, and also shows the applied force, in Newtons, estimated by the present invention.

Using the maximum fatigue stress of the valve member 21, three stops were designed respectively for $\sigma_{max}=700$, 840 and 1000 MPa where the valve thickness is 0.00038 m, the width is 0,005 m, the length is 0.027 m, the modulus of elasticity is $2\times10^1$Pa and the area moment of inertia is $0.2286\times10^{-13}m^4$. The three profiles are shown in FIG. 4. A comparison between the results obtained by the equal curvature approach and the approach of the present invention is shown in FIG. 5. The results agree well in the small x region. In the large x region, the equal curvature approach underestimates the real stress in the valve. As a result, in the case of a 38 mm radius valve stop, as illustrated, the present invention and the equal radius profile would be the same from the root to about 0,012 m where the present invention has a continually reducing radius to the tip. As a result, the tip does not strike the stop first. The applied force calculated according to the teachings of the present invention is also shown in FIG. 5. For instance, it indicates that there a contact region at about 21 mm under a 20 Newton applied static force with the stop designed for 1000 MPa.

Although a preferred embodiment of the present invention has been described and illustrated, other changes will occur to those skilled in the art. For example, while there has been a specific reference to a rolling piston compressor, this invention applies to all fixed displacement compressors using reed discharge valves. It is therefore intended that the scope of the present invention is to be limited only by the scope of the appended claims.

What is claimed is:

1. A discharge valve assembly including a valve stop and a valve member with said valve stop having a profile facing said valve member having coordinates determined by equations for beam stress and deflection:

$$\Delta F_i = \frac{I\Delta\sigma_i}{L_{i-1}\delta},$$
$$i = 1, 2, \ldots, n,$$

where $\delta$ is the half thickness of the beam in the bending direction, $$\Delta y_{i-1,j} = \frac{x_j^2(3L_{i-1} - x_j)}{6EI}\Delta F_i,$$
$$j \geqq i,$$
$$j = 1, 2, \ldots, n,$$

and by superposition at each coordinate given by equations:

$$\Delta\sigma_i = \sigma_{max} - \sigma_i,$$
$$i = 1, 2, \ldots, n,$$

$$L_i - L_0 - i\Delta x,$$
$$i = 1, 2, \ldots, n - 1,$$

$$\sigma_i = \frac{L_{i-1} - \Delta x}{L_{i-1}}\sigma_{max},$$
$$i = 1, 2, \ldots, n,$$

where the coordinates of the stop profile are $(x_j, y_{i,j}\delta_{i,j})$ where the Dirac delta function is given by:

$$\delta_{i,j} = 1 \text{ if } i = j,$$
$$= 0 \text{ if } i \neq j,$$
$$y_{i,j} = y_{i-1,j} + \Delta y_{i-1,j}$$
$$j \geqq i.$$

2. A discharge valve assembly including a valve stop and a valve member having a tip and a root with said valve stop having a profile starting at said root and having a first portion which is of an essentially constant radius and which transitions into a second portion which is of a continually decreasing radius.

3. The valve assembly of claim 2 wherein said first portion is at least 30% of said profile.

* * * * *